US007553135B2

(12) United States Patent
Cho et al.

(10) Patent No.: US 7,553,135 B2
(45) Date of Patent: Jun. 30, 2009

(54) DIAPHRAGM AIR PUMP

(75) Inventors: Hye-jung Cho, Anyang-si (KR); Xiaobing Luo, Yongin-si (KR); Zhaoying Zhou, Beijing (CN); Xing Yang, Beijing (CN); Xiongying Ye, Beijing (CN)

(73) Assignees: Samsung Electronics Co., Ltd., Suwon-si (KR); Tsinghua University, Beijing (CN)

( * ) Notice: Subject to any disclaimer, the term of this patent is extended or adjusted under 35 U.S.C. 154(b) by 812 days.

(21) Appl. No.: 10/937,891

(22) Filed: Sep. 10, 2004

(65) Prior Publication Data

US 2005/0089415 A1 Apr. 28, 2005

(30) Foreign Application Priority Data

Sep. 12, 2003 (CN) ..... 03 1 57069
Jul. 2, 2004 (KR) ..... 10-2004-0051674

(51) Int. Cl.
*F04B 45/04* (2006.01)
*F04B 45/047* (2006.01)

(52) U.S. Cl. ..... 417/413.2; 417/322; 361/688; 361/690; 361/694

(58) Field of Classification Search ..... 417/413.2, 417/322, 436; 361/688, 690, 694
See application file for complete search history.

(56) References Cited

U.S. PATENT DOCUMENTS 4,648,807 A 3/1987 Tippetts et al.
4,708,600 A * 11/1987 AbuJudom et al. ..... 417/322
5,611,676 A 3/1997 Oomi et al.
5,759,014 A * 6/1998 Van Lintel ..... 417/413.3
5,914,856 A * 6/1999 Morton et al. ..... 361/690
6,109,889 A 8/2000 Zengerle et al.
6,203,291 B1 * 3/2001 Stemme et al. ..... 417/413.3
2003/0017063 A1 * 1/2003 Komatsu et al. ..... 417/413.2
2003/0068242 A1 4/2003 Yamakawa

FOREIGN PATENT DOCUMENTS

JP 5-296150 11/1993
JP 2002-322986 A 11/2002
WO WO 00/39463 A1 7/2000

* cited by examiner

*Primary Examiner*—Devon C Kramer
*Assistant Examiner*—Patrick Hamo
(74) *Attorney, Agent, or Firm*—Sughrue Mion, PLLC

(57) ABSTRACT

A diaphragm air pump comprises a pump chamber, a diaphragm and one or more piezoelectric beams or bimorphs. Fluid flows into the pump chamber and then flows out of it, the diaphragm is provided within the pump chamber, and one or more central openings are formed in the diaphragm. One or more central check valves are provided in the central openings. The diaphragm is just bonded with piezoelectric beams, not fixed to the lower housing of the pump chamber in order to get large displacement. With the provided diaphragm air pump, it is possible to actively adjust the air quantity according to the requirement for fuel cell or a part-to-be-cooled, and it is also possible to reduce noise and power consumption compared with a conventional fan type cooler or air pumps.

15 Claims, 4 Drawing Sheets

DIAPHRAGM AIR PUMP

CROSS-REFERENCE TO RELATED APPLICATIONS

This application claims the benefit of Chinese Patent Application No. 03157069.0 filed on Sep. 12, 2003 in the State Intellectual Property Office of the People's Republic of China and Korean Patent Application No. 2004-51674 filed on Jul. 2, 2004 in the Korean Intellectual Property Office, the disclosures of which are incorporated herein by reference in their entirety.

BACKGROUND OF THE INVENTION

1. Field of the Invention

The present invention relates to a diaphragm air pump, and more particularly, to a compact diaphragm air pump driven by a bimorph.

2. Description of the Related Art

In general, a compact air supply apparatus such as an air pump is used to supply a certain quantity of air to a compact electronic appliance or device.

As integration of transistors increases in compact electronic appliances or devices, microelectronic parts may be caused to malfunction or damaged due to heat produced within the electronic appliances or devices. Therefore, the problem of cooling microelectronic parts becomes an important issue for those electronic appliances using such microelectronic parts.

In particular, when a fuel cell is employed as a power source for a portable appliance, it is required to supply oxygen for chemical reaction.

In addition, as electronic appliances such as computers become more compact, coolers for cooling chips therein should occupy a smaller volume of space while consuming less power. Moreover, those coolers are expected to perform cooling operation with high efficiency while generating little noise, and also they are required to have high operation reliability.

A conventional air supply apparatus used in a compact electronic appliance or device is constructed as a rotary fan built-in type, or constructed as an external cooling fin type for facilitating heat conduction or air convection so as to achieve the cooling or air delivery target.

However, the cooler or air supply apparatus for a fuel cell with the above-mentioned constructions may generate noise due to the running of a rotary fan, and also because they occupy a predetermined volume of space for their own, it will render a limit in miniaturization of an electronic appliance or device.

In addition, upon considering an aspect of cooling efficiency of the rotary fan and fin, it is difficult to achieve a cooling efficiency needed for an electronic appliance or device. Particularly, in case of the rotary fan type, power consumption is very high.

Furthermore, because most of the existing air pumps for air delivery are large in size and volume and generate excessive noise, it is difficult to apply them in portable appliances that require miniaturization.

SUMMARY OF THE INVENTION

To solve parts of the above-mentioned problems occurring in the related art, accordingly, the present invention is to provide a diaphragm air pump improved in structure for supplying air to cool the compact electronic appliances or delivering air to a predetermined space.

A diaphragm pump is provided according to an embodiment of the present invention comprising: a pump chamber, wherein fluid flows into the pump chamber and then flows out of the pump chamber; a diaphragm provided within the pump chamber, wherein the diaphragm is formed with one or more central openings with central check valves in the central openings; and one or more piezoelectric beams each connected to one side of the diaphragm, wherein electric power is applied to the piezoelectric beams and fluid is supplied to a part-to-be-cooled as the piezoelectric beams vibrate.

The pump chamber may comprise: an upper case formed with one or more inlet openings, through which the fluid flows into the upper case; and a lower case formed with one or more outlet openings, through which the fluid from the upper case flows in and out of the lower case after contacting with the part-to-be-cooled.

The inlet openings may be provided with inlet check valves for controlling external fluid to flow into the upper case.

In an embodiment, the diaphragm may be provided between the upper case and the lower case, and the central check valves are capable of controlling the fluid within the upper case to flow into the lower case.

The lower case may be provided with slots for installing the piezoelectric beams.

Two slots and two piezoelectric beams may be provided.

The inlet openings may be formed in the top of the upper case or in sidewalls of the lower case.

The sidewalls of the upper case may be formed with lateral openings, in which lateral check valves are installed and the openings in the lower case can also be formed as diffusers or nozzles.

BRIEF DESCRIPTION OF THE DRAWINGS

The above features and advantages of the present invention will be more clear from the following detailed description with reference to the corresponding drawings, in which.

Figure 1:
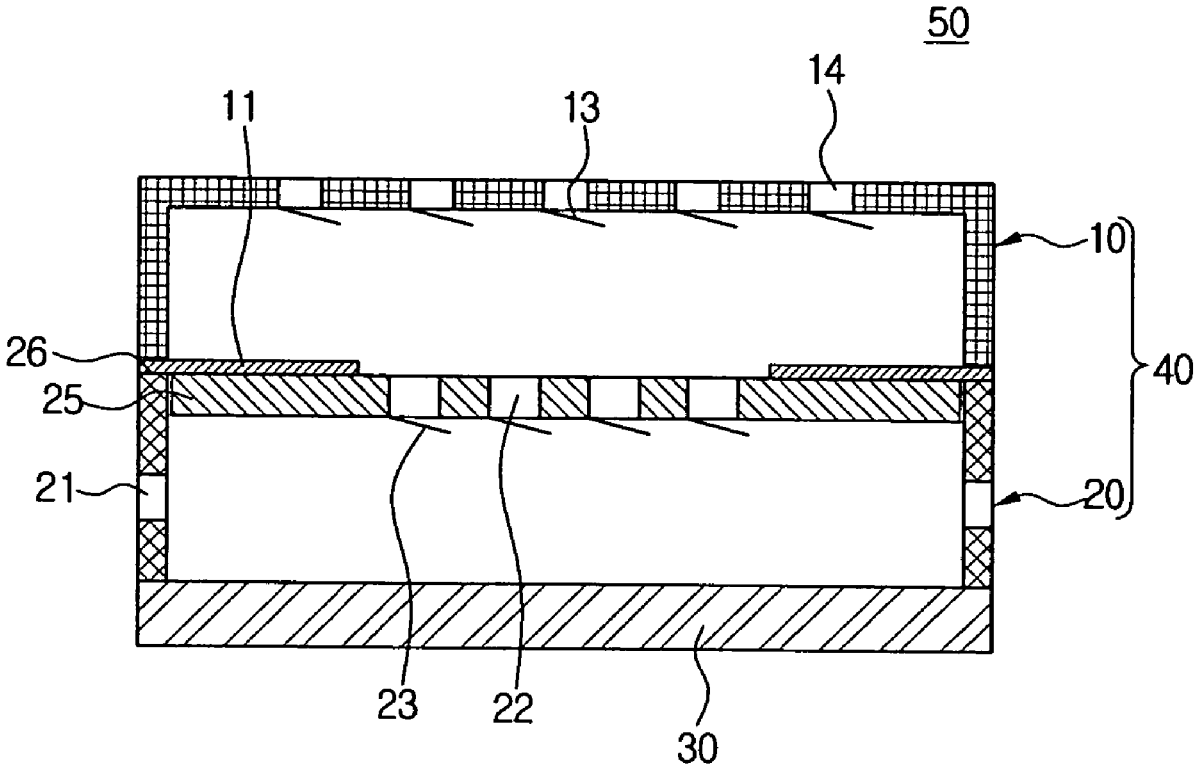
FIG. 1 is a cross-sectional view of a diaphragm air pump according to the first embodiment of the present invention.

In these figures, it will be understood that the reference numerals refer to the features and structures of the present invention.

DETAILED DESCRIPTION OF THE EMBODIMENTS

Figure 2:
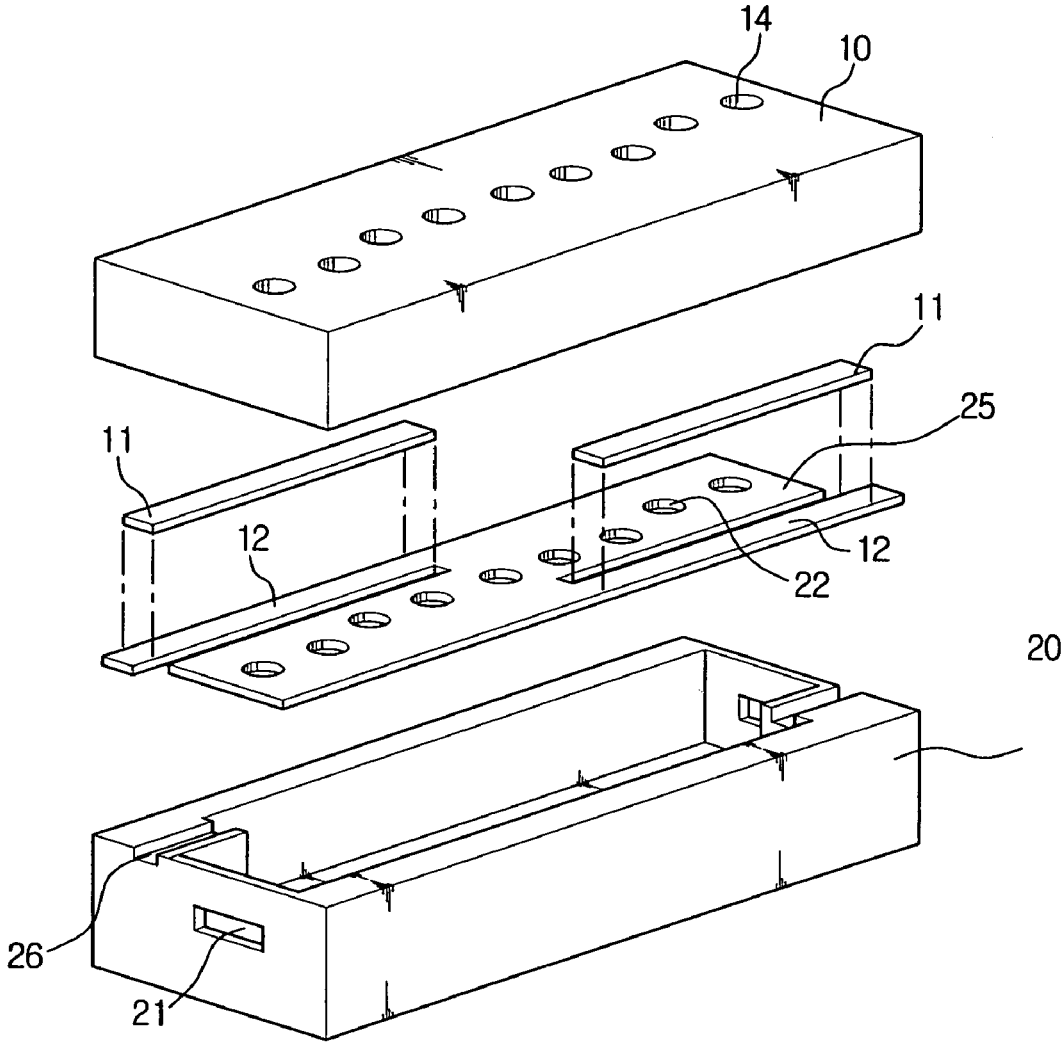
FIG. 2 is a perspective view of the diaphragm air pump shown in FIG. 1.
Figure 3:
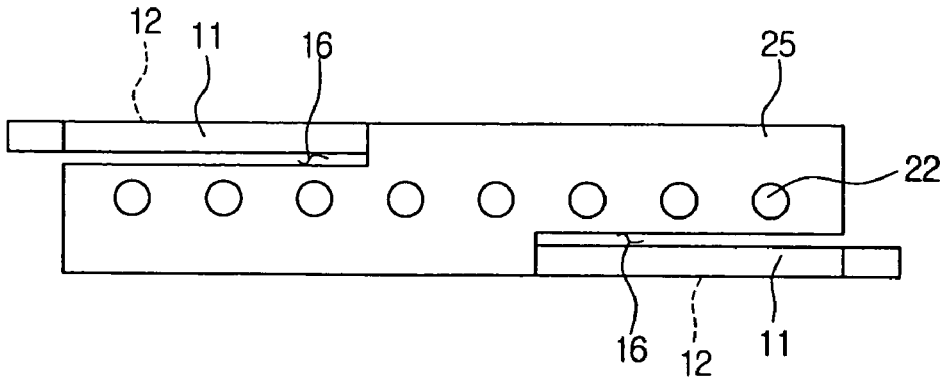
FIG. 3 is a top plan view of the diaphragm with piezoelectric beams shown in FIGS. 1 and 2.

Diaphragm air pumps according to the embodiments of the present invention will be described in detail with reference to the accompanying figures. FIG. 1 is a cross-sectional view of a diaphragm air pump according to the first embodiment of the present invention, FIG. 2 is a perspective view of the diaphragm air pump shown in FIG. 1, FIG. 3 is a top plan view of the diaphragm with the piezoelectric beams shown in FIGS. 1 and 2.

Referring to these drawings, the diaphragm air pump 50 generally comprises a pump chamber 40, a diaphragm 25 provided in the pump chamber 40, and one or more piezoelectric beams 11.

The pump chamber 40 provides an appearance of the diaphragm air pump 50, and external fluid, such as air, flows into the pump chamber 40 and flows out of it. In addition, the pump chamber 40 comprises an upper case 10 and a lower case 20.

In the top of the upper case 10, one or more inlet openings 14 are formed, through which fluid flows into the upper case 10.

The lower case 20 is engaged with the upper case 10, and one or more outlet openings 21 are formed in the sidewalls of the lower case 20. The fluid having flown into the upper case 10 is brought into contact with and cools a part-to-be-cooled 30 and then flows out through the outlet openings 21. At this time, the part-to-be-cooled 30 may be an air supply section for a fuel cell (not shown).

In addition, an inlet check valve 13 is installed in each inlet opening 14 to control the fluid to flow in one way, so that external fluid flows only into the upper case 10 and prevents the fluid within the upper case 10 from flowing out through the inlet openings 14. And, the lower case 20 is formed with slots for installing the piezoelectric beams 11.

In an exemplary embodiment, two piezoelectric beams 11 and two slots 26 are provided in order to apply vibration to opposite sides of the diaphragm 25.

The diaphragm 25 is provided within the pump chamber 40. Specifically, the diaphragm 25 is provided between the upper case 10 and the lower case 20 and the diaphragm 25 is formed with one or more central openings 22.

A central check valve 23 is provided in each central opening 22 to control the flow of the fluid, so that the fluid within the upper case 10 flows only into the lower case 20 and is prevented from flowing backward into the uppercase 10.

In addition, the central check valves 23 and the inlet check valves 13 are formed from a flexible membrane and they open or close depending on the pressure difference between the upper case 10 and the lower case 20.

Each piezoelectric beam 11 is fixed to one side of the diaphragm 25 by an adhesive material, and if electric power is applied to the piezoelectric beams 11 from the exterior of the diaphragm pump 50, the piezoelectric beams 11 vibrate. At this time, the diaphragm 25 is formed with gap 16 spaced from connection parts 12 between the piezoelectric beams 11 with the diaphragm 25.

Figure 4A:
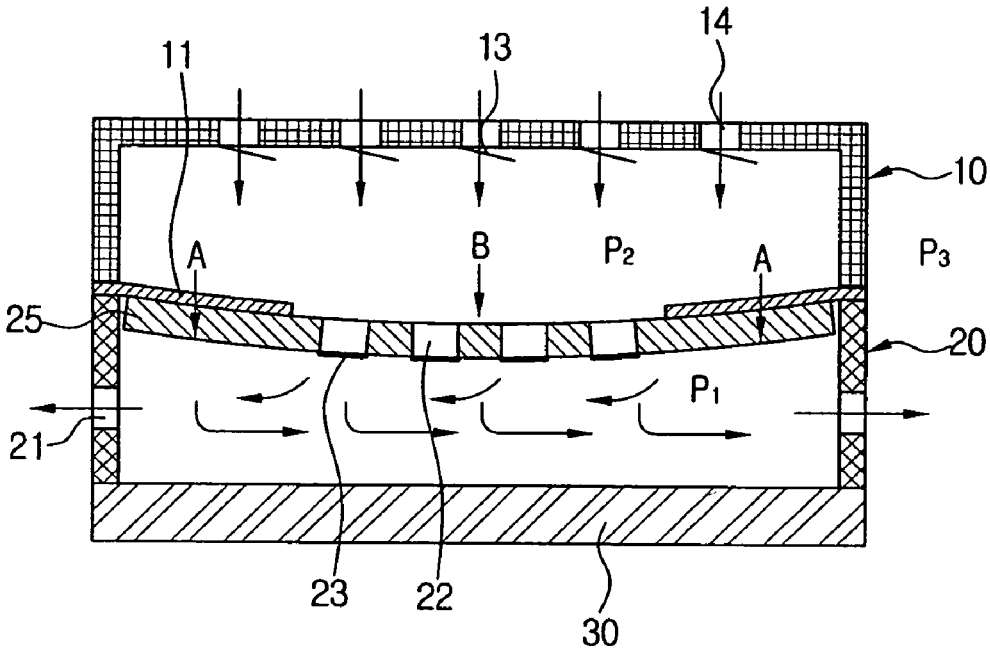
FIGS. 4A and 4B illustrate the operation of the diaphragm air pump shown in FIGS. 1 and 2.
Figure 4B:
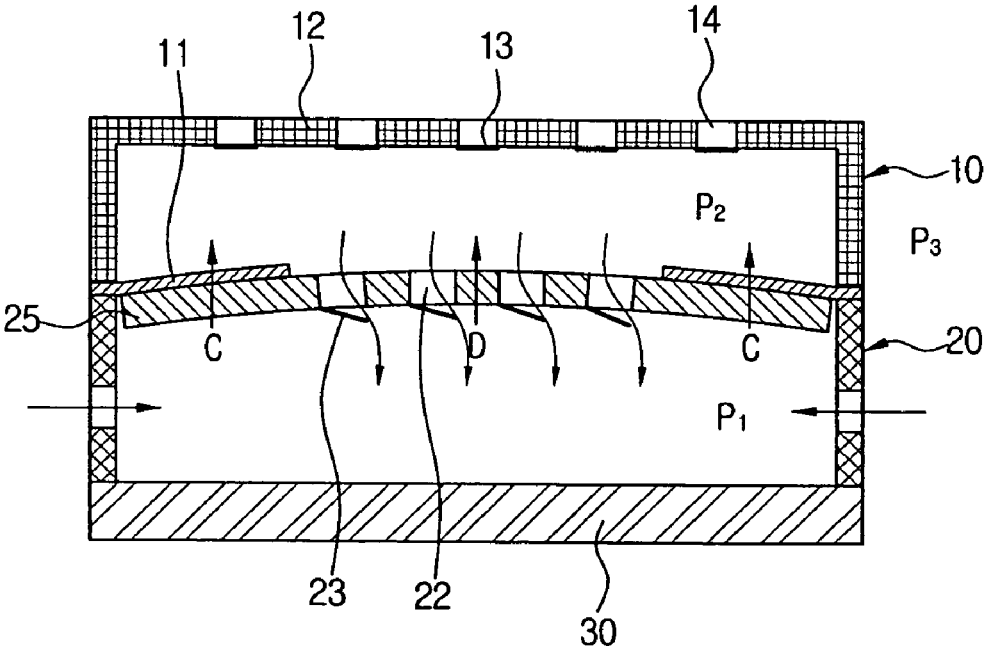

The operation of the diaphragm air pump 50 according to an embodiment of the present invention will be described with reference to FIGS. 4A and 4B. FIG. 4A shows the flow of fluid when the piezoelectric beams 11 move toward the part-to-be-cooled 30, and FIG. 4B shows the flow of fluid when the piezoelectric beams 11 moves away from the part-to-be-cooled 30.

Referring to the drawings, voltage is applied to the piezoelectric beams 11 of the diaphragm air pump 50. The applied voltage is alternating and when it is applied, the piezoelectric beams 11 vibrate up and down.

If external force is applied to such piezoelectric beams 11, the beams generate electric energy (e.g., voltage) corresponding to the external force, i.e., mechanical energy, whereas if electric energy is applied to the piezoelectric beams 11, the beams generate mechanical energy. At this time, the piezoelectric beams 11 have a unique characteristic of vibrating if the applied electric energy is alternating voltage.

When alternating voltage is applied to the piezoelectric beams 11 in this manner, the piezoelectric beams 11 vibrate, however, one end of each piezoelectric beam 11 is completely fixed in the slots 26 of the pump chamber 40. Therefore, the other end of each piezoelectric beam 11 will vibrate up and down. Such vibration has the maximum amplitude when the frequency of the alternating voltage and the intrinsic frequency of the piezoelectric beams 11 are the same.

As the piezoelectric beams 11 vibrate up and down in this manner, the diaphragm 25 which is fixed to the piezoelectric beams 11 by an adhesive material also vibrates. Since the diaphragm is not fixed to the pump chamber 40, but just fixed to diaphragm 25, its displacement will be much larger than that of fixed design.

Description will be made to the case where the piezoelectric beams 11 vibrate in the direction indicated by arrows A, i.e., downward of the pump chamber 40. At this time, the diaphragm 25 also vibrates in the direction indicated by arrow B, i.e., downward of the pump chamber 40.

In this case, the pressure P1 of the fluid within the lower case 20 becomes higher than that of the fluid within the upper case 10, so the central check valves 23 are closed due to such pressure difference. The fluid within the lower case 20 is brought into contact with and cools the part-to-be-cooled 30 or supplies required fluid such as air to the part-to-be-cooled 30.

At this same time, as the pressure P2 within the upper case 10 is lower than the surrounding pressure P3 of the pump chamber 40, the fluid surrounding the pump chamber 40 flows into the upper case 10 through the inlet openings 14 and the inlet check valves 13 are in the state of being opened.

Simultaneously, the fluid within the lower case 20 flows out of the pump chamber 40 through the outlet openings 21.

Now, description will be made as to the case when the piezoelectric beams 11 vibrate in the direction indicated by arrows C, i.e., upward of the pump chamber 40. At this time, the diaphragm 25 also moves to the direction indicated by arrow D, i.e., upward of the pump chamber 40.

In this case, the pressure P1 of the fluid within the lower case 20 becomes lower than that of the fluid within the upper case 10, so the central check valves 23 are opened due to such pressure difference.

At the same time, because the pressure P2 within the upper case 10 is higher than the surrounding pressure P3 outside of the pump chamber 40, the inlet check valves 13 are closed.

Therefore, the fluid having flown into the upper case 10 as shown in FIG. 4A flows into the lower case 20 through the central openings 22 formed in the diaphragm 25. And, because the pressure P1 of the fluid within the lower case 20 is lower than the surrounding pressure P3 of the pump chamber 40, the surrounding air may partially flow into the lower case 20 through the outlet openings 21.

As the piezoelectric beams 11 vibrate up and down in this manner, the diaphragm 25 also vibrates, whereby it can supply a certain quantity of fluid such as air to the part-to-be-cooled 30, thereby it can realize cooling or supplying a certain quantity of air to the part-to-be-cooled 30.

Because the diaphragm 25 is connected to the piezoelectric beams 11 rather than directly secured to the pump chamber 40, and also spaces 16 are formed between the piezoelectric beams 11 and the diaphragm 25 with a predetermined distance, the diaphragm 25 generally takes a form of floating within the pump chamber 40, whereby the volumetric change rates of the fluid within the upper case 10 and the lower case 20 are greatly increased.

As a result, because the pressure difference, $|P1-P2|$, caused by the vibration of the diaphragm 25 is increased, it is possible to realize an air pump of a higher efficiency with a smaller volume and a simpler construction.

In addition, the quantity of air supplied to an air supply section of a fuel cell (not shown) or a part-to-be-cooled 30 by the diaphragm 25 is varied depending on the vibration amplitude in the A and C directions of the piezoelectric beams 11. Correspondingly, it is also varied with the frequency of the applied voltage. Therefore, it is possible to actively adjust the quantity of air supplied to the part-to-be-cooled 30 by changing the applied voltage according to the air quantity required for the part-to-be-cooled 30.

Figure 5:
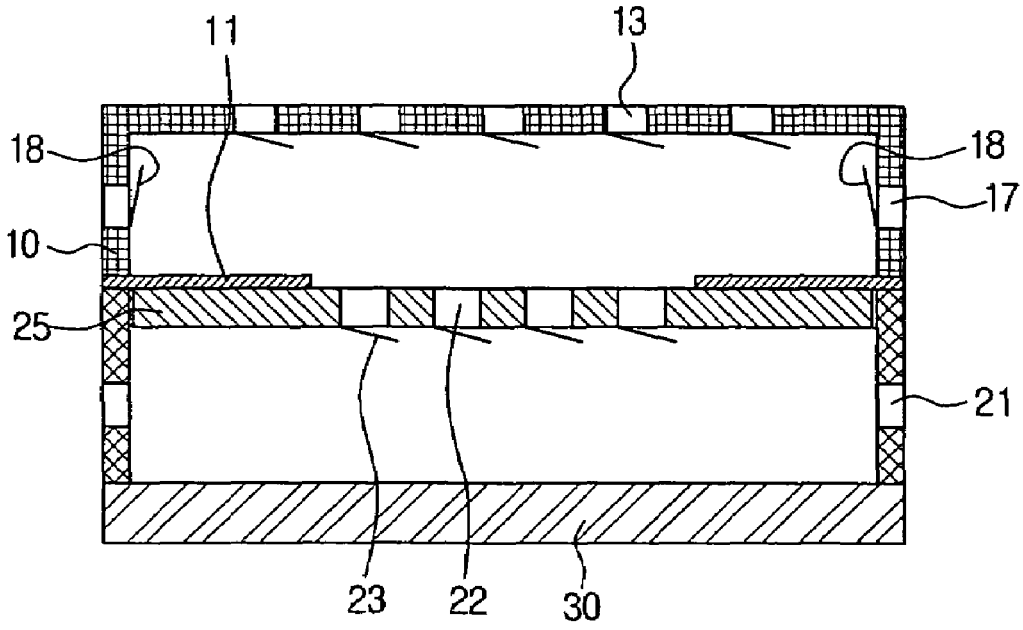
FIGS. 5 and 6 are cross-sectional views of diaphragm air pumps of the second and third embodiments of the present invention.
Figure 6:
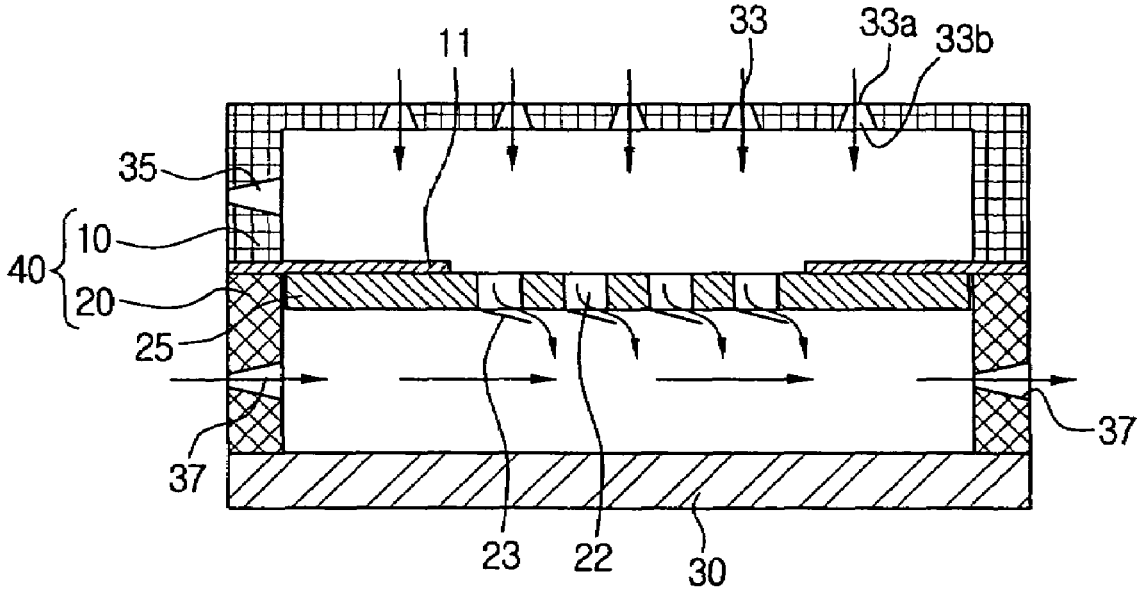

FIGS. 5 and 6 illustrate second and third embodiments of the present invention.

Referring to FIG. 5, the opposite sidewalls of the upper case 10 are formed with lateral openings 17. Each lateral opening 17 is provided with a lateral check valve 18. Such lateral check valves 18 control the flow of fluid so that the fluid flows only into the upper case 10 like the inlet check valves 13 as mentioned above. The operation and construction of the diaphragm air pump are similar to those of the diaphragm air pump shown in FIGS. 1 to 4B, except that the lateral check valves 18 are provided in the lateral openings 17.

Since the lateral check valves 18 and the inlet check valves 13 are formed in the upper case 10, the quantity of fluid flowing into the pump chamber 40 is increased compared to the diaphragm air pump 50 shown in FIGS. 1 to 4B.

FIG. 6 illustrates a construction of a diaphragm air pump in which inlet diffusers 33, lateral diffusers 35, and outlet diffusers 37 are provided instead of the check valves 13, 18 and the outlet openings 21 shown in FIG. 5. The diffusers 33, 35, 37 also render fluid to flow in only one direction by a pressure difference. For example, in the case of the inlet diffusers 33, the inflow of the fluid into the upper case 10 is relatively easy when the pressure in narrow parts 33*a* of the diffusers is higher than that in wide parts 33*b* of the diffusers. Consequently, because the quantity of fluid flowing into upper case 10 through the inlet diffusers 33 from the exterior of the pump chamber 40 is relatively larger than that of fluid flowing out of the inlet diffusers 33, the inlet diffusers 33 serve as a kind of one-way check valves.

In this embodiment, the operation and construction of the diaphragm air pump are similar to those of the diaphragm air pump shown in FIGS. 1 to 4B, except that the diffusers 33, 35, 37 are employed.

As a diaphragm air pump according to the present invention employs a diaphragm to supply air or to cool a predetermined space, compared to an air pump for supplying oxygen used in a conventional fan type cooler or a fuel cell, it is possible to reduce noise and power consumption.

In addition, because existing air pumps are large in size and volume and generate excessive noise, they are not suitable for portable appliances that require miniaturization. However, because a diaphragm air pump according to the present invention can actively adjust the flow rate of air by changing applied voltage and generates little noise, it is possible to employ the diaphragm air pump as an air delivery system for a fuel cell requiring oxygen for chemical reaction.

As described above, according to the present invention, the volumetric change rates of an upper case and a lower case are increased, whereby the pressure difference caused by the vibration of a diaphragm will be increased. Therefore, it is possible to realize an air pump of a higher efficiency with a smaller volume and a simpler construction.

Moreover, this air pump is possible to actively adjust the air quantity or fluid according to application requirement, and it is possible to reduce noise and power consumption compared with a conventional fan type cooler or existing air pumps.

In addition, because it is possible to deliver enough air flow rate for a fuel cell, it is possible to employ the diaphragm air pump as an air-side fuel supply system.

While the embodiments of the present invention have been shown and described thereof in order to illustrate the principle of the present invention, the present invention is not limited to the embodiments. It will be understood that various modifications and changes can be made by those skilled in the art without departing from the spirit and scope of the invention as defined by the appended claims. Therefore, it shall be considered that such modifications, changes and equivalents thereof are all included within the scope of the present invention.

What is claimed is:

1. A diaphragm air pump comprising:

a pump chamber, wherein fluid flows into the pump chamber and then flows out of the pump chamber;

a diaphragm provided within the pump chamber, wherein the diaphragm comprises one or more central openings and one or more central check valves in the central openings; and one or more piezoelectric beams each connected to one side of the diaphragm, wherein electric power is applied to the piezoelectric beams and the fluid is supplied to a part-to-be-cooled as the piezoelectric beams vibrate;

wherein the diaphragm is connected to the pump chamber by the one or more piezoelectric beams.

2. The diaphragm air pump according to claim 1, wherein the pump chamber comprises:

an upper case comprising one or more inlet openings, through which the fluid flows into the upper case; and a lower case comprising one or more outlet openings, through which the fluid having flown into the upper case flows out of the lower case after contacting with the part-to-be-cooled.

3. The diaphragm air pump according to claim 2, wherein the inlet openings are provided with inlet check valves for controlling external fluid to flow into the upper case.

4. The diaphragm air pump according to claim 3, wherein the diaphragm is disposed between the upper case and the lower case, and the central check valves are operable to control the fluid in the upper case to flow into the lower case.

5. The diaphragm air pump according to claim 3, wherein the diaphragm is bonded with parts of the piezoelectric beams, but not fixed to the lower case of the pump chamber.

6. The diaphragm air pump according to claim 2, wherein the lower case comprises slots for installing the piezoelectric beams.

7. The diaphragm air pump according to claim 6, wherein two slots and two piezoelectric beams are provided.

8. The diaphragm air pump according to claim 7, wherein one side of the two piezoelectric beams is fixed to the lower case of the pump chamber respectively.

9. The diaphragm air pump according to claim 7, wherein the two piezoelectric beams comprise bimorphs.

10. The diaphragm air pump according to claim 2, wherein the inlet openings are disposed in the top of the upper case.

11. The diaphragm air pump according to claim 2, wherein the outlet openings are disposed in sidewalls of the lower case.

12. The diaphragm air pump according to claim 2, wherein sidewalls of the upper case comprise lateral openings, in which lateral check valves are installed in the lateral openings.

13. The diaphragm air pump according to claim 2, wherein the inlet openings and the outlet openings comprise diffusers.

14. The diaphragm air pump according to claim 1, wherein the one or more piezoelectric beams comprises at least two piezoelectric beams, wherein the diaphragm is connected to the pump chamber by one of the piezoelectric beams and by another of the piezoelectric beams, such that the diaphragm is not directly connected to the pump chamber, and the one of the piezoelectric beams and the other of the piezoelectric beams are connected to the pump chamber at opposite sides of the diaphragm.

15. The diaphragm air pump according to claim 1, wherein the pump chamber further comprises sidewalls;

the diaphragm further comprises an upper surface, a lower surface a central portion and sides;

the central portion is provided between the sides;

the one or more central openings and one or more central check valves in the central openings are provided in the central portion; and the central openings extend from the upper surface to the lower surface.

* * * * *